United States Patent [19]

Bodenbenner et al.

[11] 4,288,211

[45] Sep. 8, 1981

[54] PROCESS AND DEVICE FOR THE INTRODUCTION OF EXPLOSIVE GASES INTO A COMBUSTION CHAMBER

[75] Inventors: Kurt Bodenbenner, Wiesbaden; Gerhard Müller, Kelkheim; Helmut Perkow, Hofheim am Taunus, all of Fed. Rep. of Germany

[73] Assignee: Hoechst Aktiengesellschaft, Frankfurt am Main, Fed. Rep. of Germany

[21] Appl. No.: 973,585

[22] Filed: Dec. 27, 1978

[30] Foreign Application Priority Data

Dec. 30, 1977 [DE] Fed. Rep. of Germany ..... 2758819

[51] Int. Cl.[3] ..... F23D 13/46

[52] U.S. Cl. ..... 431/346; 431/10; 431/180; 431/190; 239/424.5; 239/429; 48/192

[58] Field of Search ..... 431/8, 5, 10, 12, 180, 431/190, 346, 178, 179; 239/424.5, 429, 431; 48/192

[56] References Cited

U.S. PATENT DOCUMENTS

| | | | |
|---|---|---|---|
| 648,964 | 5/1900 | Kitson | 431/346 |
| 982,655 | 1/1911 | Albee | 239/431 |
| 1,044,651 | 11/1912 | Harris | 239/429 |
| 1,227,277 | 5/1917 | Land | 431/346 X R |
| 1,423,650 | 7/1922 | Decuir | 239/431 X R |
| 1,653,297 | 12/1927 | Labelle | 239/431 X R |
| 2,403,188 | 7/1946 | McCollum | 431/346 X R |
| 3,015,127 | 1/1962 | Stalego | 239/431 X R |
| 3,807,940 | 4/1974 | Juricek | 431/346 |
| 4,152,399 | 5/1979 | Germerdonk et al. | 431/5 X R |

FOREIGN PATENT DOCUMENTS

| | | | |
|---|---|---|---|
| 2545234 | 4/1977 | Fed. Rep. of Germany | 239/424.5 |
| 474904 | 1/1915 | France | 239/431 |
| 83510 | 12/1956 | Netherlands | 239/429 |
| 368680 | 7/1932 | United Kingdom | 431/346 |

*Primary Examiner*—Robert S. Ward, Jr.

*Attorney, Agent, or Firm*—Curtis, Morris & Safford

[57] ABSTRACT

When explosive gases are introduced into a combustion chamber care must be taken that no pre-ignition occurs. To this end, the gas is spatially subdivided into discrete volume elements, for example by means of a bundle of tubes having an internal diameter which does not exceed twice the quenching distance of the explosive gases. Such a division ensures that the wall distances of the gas portions of one volume element are greater than their quenching distances.

2 Claims, 2 Drawing Figures

Figure 1:
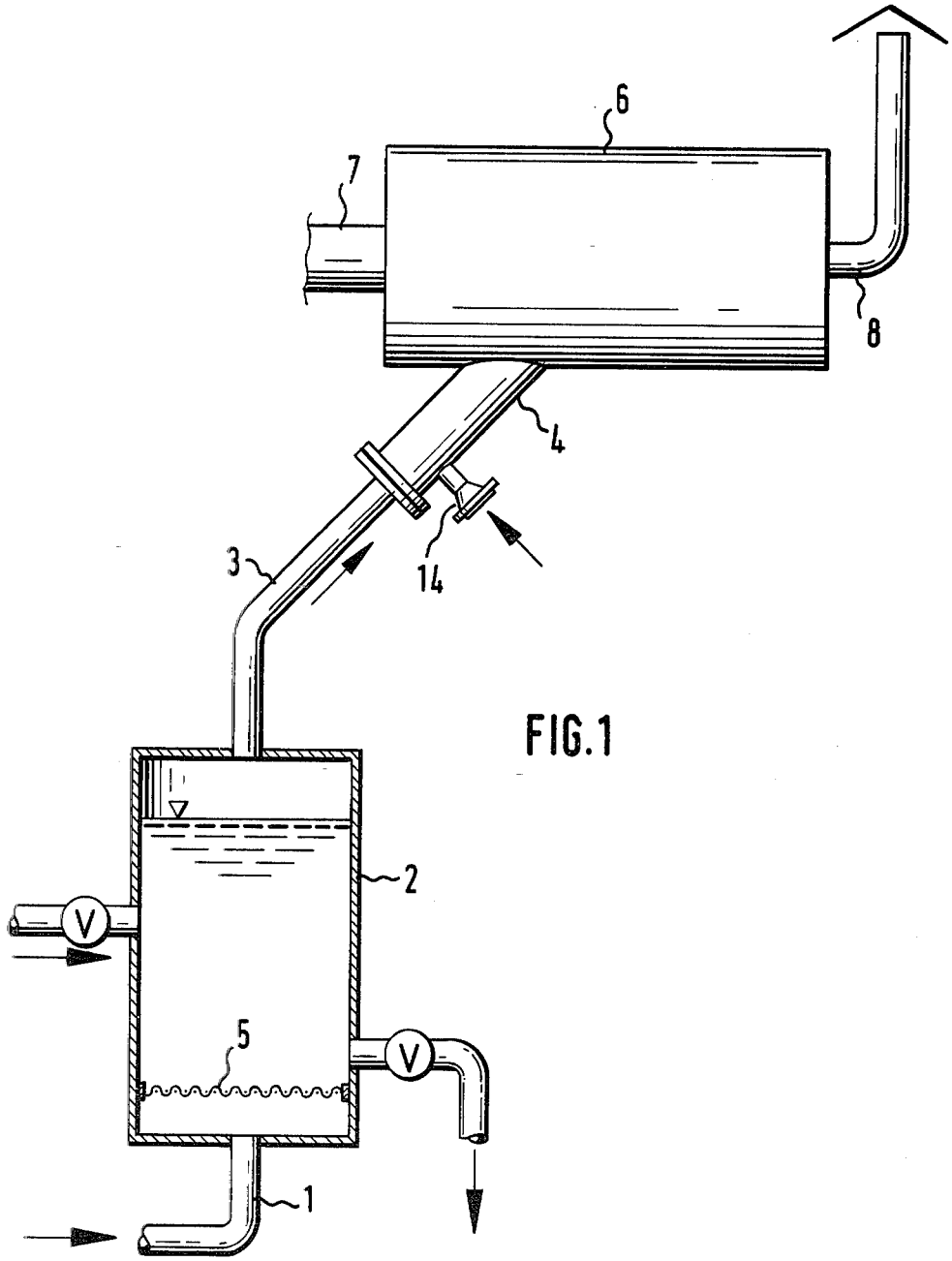

PROCESS AND DEVICE FOR THE INTRODUCTION OF EXPLOSIVE GASES INTO A COMBUSTION CHAMBER

In many processes gases or gas mixtures are formed that are explosive due to their composition. In the following the term "explosive gases" means pure gases and mixtures of different gases. Explosive gases of this type are, for example, solvent-containing exhaust air from viscose plants. So far these explosive gases were often emitted into the atmosphere without previous purification. By the recent emission restrictions this possibility is substantially limited.

It is known to absorb the combustible portions of explosive gases with the aid of suitable washing agents in wash columns. A substantial disadvantage of this process resides in the expensive regeneration of the washing agent.

It is also known to purify explosive gases of the aforesaid type in adsorption towers. In this process the disadvantages reside in the spontaneous ignition of the adsorbent with a high load and the high regeneration costs.

Still further, various methods are known to burn explosive gases:

(1) Dilution of the gases with air or inert gas so that the composition is outside of the explosion range. In this case high amounts of energy are required to burn the diluted gas.

(2) Introduction of the explosive gases into the combustion chamber at a high speed in order to avoid pre-ignition. This process necessitates a high expenditure pertaining to measuring and control engineering. Moreover, failures in the plant may involve explosions.

(3) Introduction of the explosive exhaust gases into water in a reservoir installed in the combustion chamber. This process has the disadvantage that a relatively large portion of water continually evaporates (loss of thermal energy), which must be replenished.

It is, therefore, the object of the present invention to develop a process according to which explosive gases can be introduced into a combustion chamber while pre-ignition is avoided.

It is another object of the invention to provide a device suitable for carrying out the said process.

To solve the problem, a process is provided which comprises subdividing the explosive gas spatially into discrete volume elements in a manner such that in the volume elements no portion of the gas has a distance from the wall that is greater than its quenching distance and then introducing the explosive gas into the combustion chamber.

It can be advantageous to cool the explosive gas subdivided into volume elements, for example by means of the air used for combustion. It can also be advantageous to pass the explosive gas through an immersion receiver prior to being divided.

The device for carrying out the process of the invention comprises a tubular casing and in said casing a plurality of tubes the internal diameter of which corresponds to at most twice the quenching distance of the explosive gases. It proved advantageous to use a casing partially having a double shell and a bundle of tubes preferably opening into a spacer ring which is followed by a gas-permeable radiation protection. The spacer ring is provided with a jacket with perforations which are in communication with the hollow space of the double shell.

Figure 2:
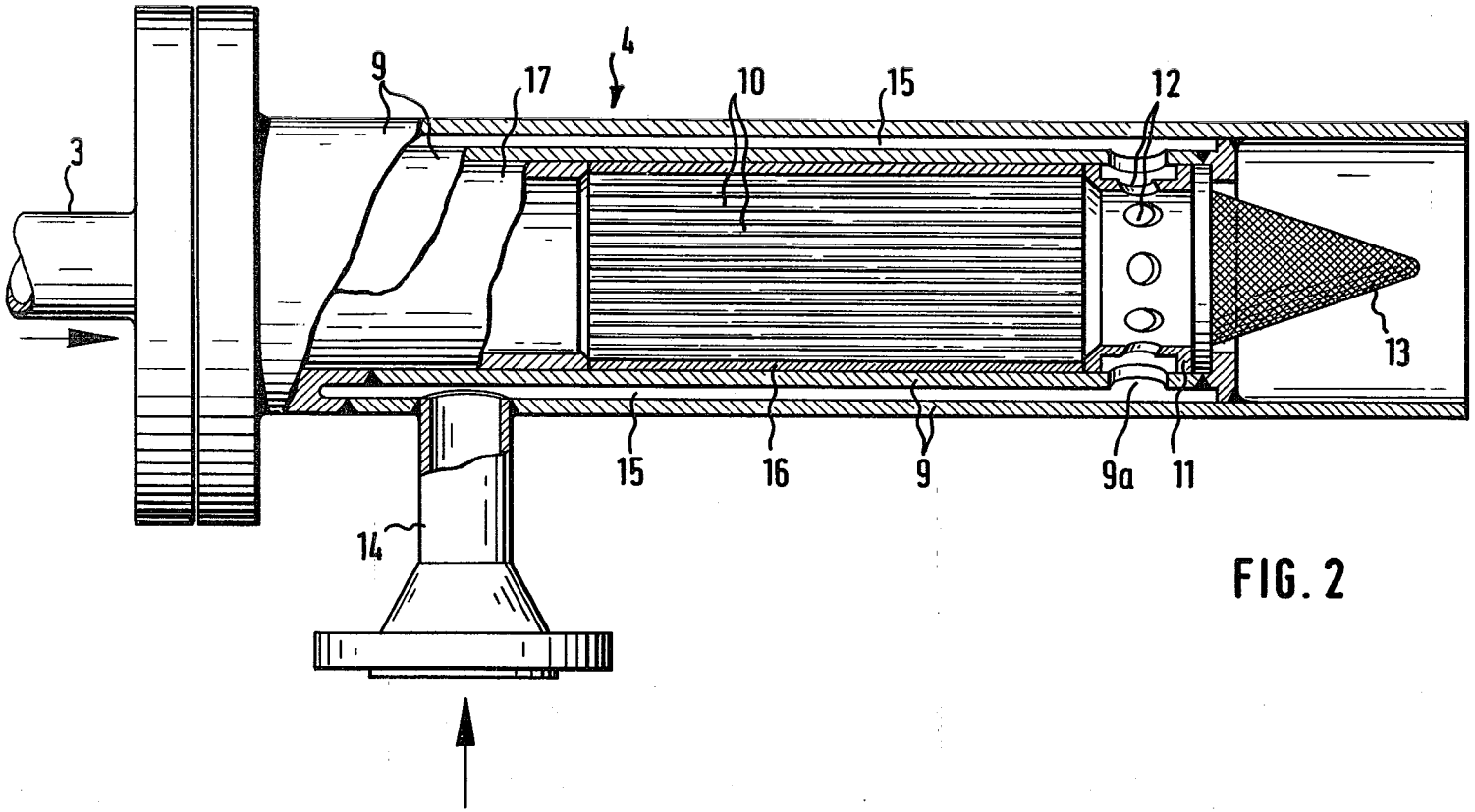

The process and device of the invention are illustrated in the accompanying drawing, in which FIG. 1 is a view, partly in cross-section, showing the flow of gas into a combustion chamber, and FIG. 2 is a view, in cross-section and in greater detail, of a device for introducing the gas into a combustion chamber.

The explosive gases are introduced, via conduit 1 and gas distribution means 5, into an immersion receiver 2. The immersion receiver 2 may consist of a cylindrical vessel containing a suitable liquid, preferably water. In order to avoid the formation of channels by the ascending bubbles the receiver should have appropriate dimensions. The explosive gas passes then, via conduit 3 and introduction device 4, into combustion chamber 6 which may be provided with an auxiliary burner 7. 8 designates the chimney for the flue gases. The introduction device 4 consists of a tubular casing 9 partially having a double shell, the inner wall of which may be provided with openings 9*a*. In the casing 9 a bundle of tubes 10 is arranged. It proved advantageous to pass the gases through the device in laminar flow. Considering the fact that the tube diameter corresponds to at most twice the quenching distance and that the maximum gas speed in the tube is defined by the laminar flow and therewith the amount of gas passing through per unit of time, it is possible to calculate the number of tubes necessary for passing through a determined total amount of gas. The bundle of tubes 10 opens into a spacer ring 11, the jacket of which is provided with openings 12. The spacer ring is followed by a gas-permeable radiation protection 13, for example a funnel-shaped wire sieve which prevents the bundle of tubes from being heated by radiation from the combustion chamber. To avoid an inadmissible heating of the tubes they may be cooled additionally. To this end, suitably part of the air required for combustion can be used. The combustion air can be passed through openings 12 into the funnel-shaped structure 13 whereby it is also cooled. The length of tubes 10 must correspond at least to the length of the gap with which the quenching distance of the explosive gases has been determined. Tubes having a length of at least 2.5 cm proved to be useful. The introduction device 4 according to the invention can be connected with the combustion chamber 6 in such a manner that the explosive gas streams into said chamber either horizontally or axially.

Numeral 14 indicates the inlet of the combustion air into the hollow space 15 of double shell 9. 16 is the sleeve for the bundle of tubes 10 and 17 illustrates holding means by which the bundle of tubes 10 is held in its position in introduction device 4.

The following Example illustrates the invention.

EXAMPLE:

400 $Nm^3$/hr of an explosive gas consisting of 4% by volume of dimethyl ether, 2% by volume of methanol, 2% by volume of steam and 92% by volume of air are introduced into an combustion chamber through 3 introduction devices each containing a bundle of 1,500 tubes each with a diameter of 1 millimeter and a length of 20 cm and in the combustion chamber the gas is burned. After having reduced the amount of gas to 0 $Nm^3$/hr, the flame is extinguished in the introduction devices without pre-ignition.

What is claimed is:

1. A device for the introduction of explosive gases into a combustion chamber comprising a tubular casing, a bundle of tubes in the casing, each having an internal diameter of at most twice the quenching distance of the explosive gases, said casing being partially provided with a double shell defining a hollow space and the bundle of tubes opening into a spacer ring, said spacer ring being provided with a jacket having openings which are in communication with the hollow space of the double shell.

2. The device as defined in claim 1, wherein said spacer ring is followed in the direction of gas flow by a gas-permeable radiation protection means.

* * * * *